United States Patent [19]

Verhille

[11] 3,945,822

[45] Mar. 23, 1976

[54] IMAGE INTENSIFICATION PROCESS

[75] Inventor: Karel Eugeen Verhille, Hoboken, Belgium

[73] Assignee: AGFA-GEVAERT N.V., Mortsel, Belgium

[22] Filed: June 8, 1973

[21] Appl. No.: 368,228

[30] Foreign Application Priority Data

June 9, 1972 United Kingdom ..... 27050/72

[52] U.S. Cl. ..... 96/1 R; 96/1.5; 96/1.6; 96/68; 96/82; 250/315 R; 250/315 A

[51] Int. Cl.[2] ..... G03G 13/22

[58] Field of Search ..... 96/1.5, 1.6, 1.7, 1.8, 96/68, 82, 1 R; 250/315, 315 A

[56] References Cited

UNITED STATES PATENTS

| | | | |
|---|---|---|---|
| 2,937,944 | 5/1960 | Van Dorn et al. | 96/1.5 X |
| 2,939,787 | 6/1960 | Giaimo | 96/1.8 X |
| 3,132,963 | 5/1964 | Jarvis | 117/17.5 |
| 3,236,749 | 2/1966 | Baxendale et al. | 96/1.5 X |
| 3,313,626 | 4/1967 | Whitney | 96/68 X |
| 3,376,135 | 4/1968 | Snaper | 96/68 X |
| 3,450,532 | 6/1969 | Fichter | 96/68 X |
| 3,451,811 | 6/1969 | Brynko | 96/1.5 X |
| 3,451,816 | 6/1969 | Williams et al. | 96/68 X |
| 3,784,375 | 1/1974 | Gilman et al. | 96/1.5 X |

FOREIGN PATENTS OR APPLICATIONS

| | | | |
|---|---|---|---|
| 966,694 | 8/1964 | United Kingdom | 96/68 |

*Primary Examiner*—Roland E. Martin, Jr.
*Attorney, Agent, or Firm*—William J. Daniel

[57] ABSTRACT

A photographic material comprising a support coated at one side with one or more silver halide emulsion layers and at the opposite side with an electroconductive interlayer which in its turn is coated with a photoconductive layer essentially consisting of at least one organic photoconductive compound, said silver halide emulsion layer or layers being of the type that yield a latent image on exposure with actinic light and of which the latent image is developable to a silver image with a reducing agent applied as developing agent in silver halide photography, said electroconductive interlayer having a resistivity being at least 1000 times smaller than that of the photoconductive layer, and the composition of the non-developed photographic material being such, that the combined spectral density of the support, of the conductive interlayer and of the photoconductive layer does not exceed 0.3 in the wavelength range of 400 to 700 nm.

3 Claims, No Drawings

IMAGE INTENSIFICATION PROCESS

The present invention relates to a photographic process and materials suited for image intensification.

From the U.S. Pat. No. 3,132,963 an image intensification process is known comprising the steps of:

1. electrostatically charging the rear surface of a relatively thin transparent film support, the other surface of which integrally carries a photographic developed silver image in a gelatin layer and which support has sufficient electric resistance to store electrostatic charges except when heated, 2. exposing the silver image to radiation sufficient to heat the image and the areas of the underlying support to discharge said areas, and 3. applying xerographic toner to said rear surface of the support distributed in accordance with the electrostatic image remaining thereon.

The resolution or sharpness of the image thus produced on the rear of the film support depends on the thickness of the support.

Heat produced in the silver image has to diffuse in the underlying film support to lower the electric resistance thereof. The diffusion of heat, however, is never in perfect conformity with the silver image because lateral diffusion of heat cannot be avoided. This results in images with rather poor sharpness even when rather thin supports are used since supports of photographic materials need a minimum thickness for being sufficiently rigid, strong and dimensionally stable.

Xerothermography as described in the U.S. Pat. No. 3,132,963 although it may offer sufficiently good results in the office copying field therefore seems less suited for high accuracy graphic art halftone work and X-ray radiography for medical and metallurgical diagnosis. Xerothermography is also not suited for continuous tone reproduction.

It is an object of the present invention to provide a composite photographic material that is suited for the image intensification of an already formed photographic image of low density.

It is another object of the present invention to provide a recording process in which the image-wise exposure (E=intensity × time) may be reduced substantially and a first image resulting from the image-wise exposure is used to modulate overall applied copying light in order to form a second image which is developed in conformity with the originally produced image.

It is a further object of the present invention to provide a process for the image intensification of an image obtained by means of penetrating radiation.

We have found that these objects and other objects apparent from the following description can be accomplished by means of a photographic material comprising a support coated at one side with one or more silver halide emulsion layers and at the opposite side with an electronconductive interlayer which in its turn is coated with a photoconductive layer containing (an) organic photoconductive compound(s);

said silver halide emulsion layer or layers being of the type that yield a latent image on exposure with actinic light and of which the latent image is developable to a silver image with a reducing agent applied as developing agent in silver halide photography, said electroconductive interlayer having a resistivity being at least 1000 times smaller than that of the photoconductive layer, and the composition of the non-developed photographic material being such that the combined spectral density of the support, of the conductive interlayer and of the photoconductive layer does not exceed 0.3 in the wavelength range of 400 to 700 nm.

According to a preferred embodiment the silver halide emulsion layer or layers are suited for "direct or indirect" recording with penetrating radiation, which radiation includes, e.g., X-rays, $\gamma$-rays, $\beta$-rays, or fast electrons e.g. as obtained in an electron microscope, and neutrons.

By direct recording of penetrating radiation is meant that the latent image in the silver halide emulsion layer(s) is built up by the absorption of penetrating radiation in the silver halide grains.

By "indirect" recording of penetrating radiation is meant that the latent image in the silver halide emulsion layer(s) is built up by absorbing radiation produced with the penetrating radiation e.g. in a fluorescent screen emitting ultra-violet radiation and/or visible light to which the silver halide is inherently sensitive or has been made sensitive by spectral sensitization.

The latent silver image thus obtained is developed in a known way in order to obtain a silver image that will serve as light-modulating mask for the copying light for which the photoconductive layer at the opposite side of the substantially transparent support is sensitive.

By the image-wise exposure to said copying light the photoconductive layer obtains an image-wise increase in electric conductivity, which allows the image-wise carrying off of an electrostatic charge. The electrostatic charge pattern thus formed in conformity with the silver image is developed in the usual way by means of electrostatically attractable substances.

Photoconductive recording layers that are preferred for the purpose of the present invention are based on organic photoconductors since sufficiently transparent recording layers can be produced therewith. They are not only preferred for their transparency but likewise for their flexibility, ease of coating and capability of dye sensitization.

Many organic compounds have been reported to have photoconductive properties. Among these substances monomeric as well as polymeric compounds have been found. An organic photoconductor when having itself layer-forming properties can be applied without insulating binder, but normally is applied as a solid solution or dispersion in resin(s) or waxe(s) serving as binder.

Binderfree polymeric photoconductors have found commercial use in xerography, e.g. some halogenated derivatives of poly(N-vinylcabazole).

Solid solutions in a binder of organic photoconductors in which atoms or groups of different electron-affinity are linked by a conjugated system are particularly useful for the manufacture of photoconductive recording materials. Examples of such organic photoconductors are 2,5-bis(p-diethylaminophenyl)-1,3,4-oxadiazole, 2,5-bis (p-diethylaminophenyl)-1,3,4-triazole, 2,4,5,7-tetranitro-9-fluorenone, the quinoline derivatives described in the published German Pat. application No. P 20 13 410, the dihydro- and tetrahydroquinoline derivative described in the published German Pat. application Nos. (DOS) 2,159,804, 2,160,873 and 2,254,573.

Another useful type of photoconductive layer is based on so-called charge-transfer complexes between electron-donating or "Lewis-base" resins and electronaccepting or "Lewis-acid" solutions. For example, the resin poly(N-vinyl cabazole) can be coated on a conductive substrate with compounds such as anhydrides, fluorenones, quinones and/or acids dissolved in it.

The above described polymeric films or films of a solid solution of organic photoconductors are essentially transparent for visible light and grainless. They can be electrostatically charged, exposed, and developed with toner, followed by direct fixing of the toner to the film surface.

Colourless organic photoconductors are inherently sensitive to ultraviolet radiation but are preferably dye-sensitized to extend their spectral response into the visible region and to increase their total speed.

Suitable spectral sensitizing dyestuffs for the organic photoconductor are among others organic dyestuffs, known as methine dyes, or xanthene dyes of which the phthaleins and rhodamines are subclasses, triarylmethane dyes, e.g. crystal violet (C. I. 42,555) and the triarylmethane dyes described in the published Dutch Pat. application No. 674706. The term methine dyes includes mono- as well as polymethine dyes and they are known to those skilled in the art of the spectral sensitization of light-sensitive silver halides.

Preferred methine dyes are of the cationic type and are described e.g. in the published German Pat. application No. (DOS) 2,254,573. As preferred xanthene dyes Rhodamine B (C.I.45,170), Rose Bengale, (C.I. 45,440) and Fluorescein (C.I. 45,350) are mentioned. The spectrally sensitizing dyes are preferably added to the photoconductive recording layer composition in a proportion of 0.01 to 5 % by weight in respect of the photoconductive substance(s).

Certain organic photoconductors exhibit a prolonged "memory" on their own or by the addition of certain chemical compounds so that instead of the usual sequence of charging and exposure they can first be exposed image-wise by the copying light and then subjected to electrostatic charging whereby the recording layer selectively retains an electrostatic charge in the non-exposed portions.

Organic photoconductive recording layers in which a permanent conductivity image can be formed are described in the U.S. Pat. No. 3,113,022 and United Kingdom Patent Specification No. 964,872. In said Specifications diazonium salts are mentioned, which on exposure to electromagnetic radiation produce (a) radical(s) that irreversibly increase(s) the electro-conductivity of the recording layer. The diazonium compounds are preferably used in an amount of 0.01 to 10 % by weight in respect of a water-impermeable polymeric photoconductive compound.

Other additives well known in the art of preparing photoconductive coatings may be used with the proviso, however, that they do not reduce the required transparency too much.

The thickness of the photoconductive layers should be within the range for obtaining sufficiently transparent layers.

Good results are obtained with photo-conductive layers of a thickness between 1 and 20 $\mu$m preferably between 3 and 15 $\mu$m. Too thin layers do not have a sufficient insulating power in the absence of active electromagnetic radiation, whereas too thick layers require, extensive exposure times or process mechanically undesirable characteristics. Suitable photoconductive layers contain from 2 to 6 g of organic photoconductive compound(s) per sq.m.

In the manufacture of the recording materials of the present invention the photoconductive recording layer is applied to a transparent support which is, e.g., a glass or flexible resin support precovered with an intermediate electro-conductive layer. Suitable electro-conductive interlayers for insulating supports are, e.g., vacuum-coated metal or conductive metal compound (metal oxide or metal salt) layers such as conductive silver, tin, aluminium, tin dioxide and copper iodide layers that are still sufficiently transparent for the purpose of the present invention. The optical density of the interlayer is preferably not more than 0.30.

Further are mentioned transparent conductive polymer layers, e.g. applied from a polyionic resin such as a polystyrene sulphonic acid or a polymer containing quaternized nitrogen atoms, examples of such polymer being described in the United Kingdom Patent Specification No. 950,960.

Particularly suitable is a conductive polymer having recurring units of the following type:

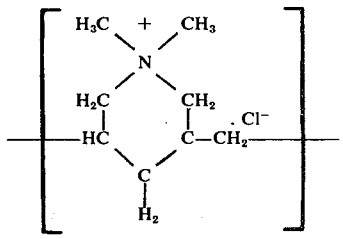

which polymer is present in CALGON CONDUCTIVE POLYMER 261 of Calgon Corporation, Inc., Pittsburgh, Pa., USA and is preferably used in a layer-forming mixture with gelatin.

The electro-conductive interlayers should have a resistivity not higher than about $10^9$ Ohm.cm and a conductivity preferably at least a factor 1000 greater than that of the support to which they are applied. Normally used transparent resin supports for photographic silver halide emulsion layers have a resistivity greater than $10^{12}$ Ohm.cm. Preferably the electroconductive layers have a surface resistance in the range of $10^5$ to $10^6$ Ohm per square at a relative humidity of 50 %.

As transparent flexible bases resin sheets having an optical density of not more than 0.10 are preferred, e.g. sheets made of polyethylene terephthalate, cellulose triacetate, cellulose nitrate, cellulose acetate butyrate, polyvinyl acetal, polystyrene, polycarbonate and related resinous materials.

When applying the recording material of the present invention for radiographic purposes there is no need to coat (a) silver halide emulsion layer(s) with particularly high silver halide content. Indeed, one of the advantages of the image intensification of the present invention is a considerable economy in silver so that we can suffice with an amount of silver halide in one emulsion layer or an aggregate amount of silver halide in a plurality of superposed silver halide emulsion layers equivalent to say 5 to 16 g of silver nitrate per sq.m.

The image-forming radiographic silver halide emulsion may comprise different types of silver halide, e.g. silver chloride, silver bromide, silver chlorobromide and silver chlorobromoiodide.

The radiographic image-forming silver halide emulsion is preferably a medium- or high-speed image-forming silver halide emulsion in which the silver halide is predominantly silver bromide, e.g., pure silver bromide emulsions and silver bromoiodide emulsions, the iodide content of which is less than 10 mole %. The average silver halide grain size is preferably comprised between 500 nm and 1200 nm.

For rapid (high temperature) processing purposes a part of the silver halide is applied from a silver chloride-containing emulsion having a sufficiently low speed that no visible image is produced therein under the conditions of exposure and development of the radiographic image-forming silver halide emulsion. Silver halide emulsions of the rapid processing type are described in the published German Patent application No. (DOS) 2,165,193.

For lowering the exposure radiographic silver halide materials are normally indirectly exposed to penetrating radiation by using intensifying screens comprising luminescent substances emitting in the U.V. or visible part, e.g. the blue region of the spectrum. For medical purposes the intensifying fluorescent screens used together with the radiographic silver halide materials contain as fluorescent substances or phosphors e.g. calcium tungstate or lead/barium sulphate, wherein advantage is taken of the inherent sensitivity of the silver halide in the U.V. and blue spectral range.

For use with other fluorescent screens emitting in the visible spectrum range, the silver halide may, however, be spectrally sensitized by any of the known techniques. It may be spectrally sensitized to light of the wavelength bands emitted by said screens under the influence of X-ray irradiation by means of any of the common spectrally sensitizing dyes used in silver halide emulsions, particularly silver halide colour emulsions. Such dyes include cyanine dyes and merocyanine dyes as well as other dyes described by F. M. Hamer in "The Cyanine Dyes and related compounds", Interscience Publishers (1964).

The photosensitive silver halide emulsion(s) when used in the exposure with visible light emitting fluorescent intensifying screens are spectrally sensitized.

When used e.g. in combination with intensifying screens emitting green light the spectral sensitization of the silver halide is effected e.g. for light of a wavelength comprised between 480 and 600 nm.

The intensifying screens emitting green light for use together with green-sensitized radiographic materials of the present invention preferably comprise fluorescent materials of the rare earth elements with atomic number 39 or 57 to 71 which include yttrium, gadolinium, lanthanum, cerium, etc. Particularly suitable are the rare earth oxysulphide an oxyhalide fluorescent materials activated with other selected rare earths e.g. lanthanum and gadolinium oxybromide and oxychloride activated with terbium or dysprosium, lanthanum, and gadolinium oxysulphides activated with terbium, europium or a mixture of europium and samarium. These rare earth fluorescent materials have been extensively described in recent literature e.g. in German Patent Specification No. 1,282,819, French Patent Specification Nos. 1,504,341, 1,580,544 and 2,021,397, French Patent of Addition 94,579 to 1,473,531, U.S. Pat. No. 3,546,128 and in K.A. Wickersheim et al. "Rare Earth Oxysulphide X-Ray Phosphors", IEEE Nuclear Science Symposium, San Francisco, October 29–31, 1969 and in Buchanan J.Appl.-Phys., April 1971. These rare earth fluorescent materials, especially the gadolinium and lanthanum oxysulphides and oxyhalides activated with other selected rare earths e.g. erbium, terbium, and dysprosium have a high X-ray "stopping power" or average absorption and high fluorescent light emission intensity, which makes it possible for radiologists to use substantially lower X-ray dosage levels.

In the radiographic exposure the X-ray intensifying screen of the fluorescent type is optionally arranged in combination with a metal screen emitting secondary electrons.

The photosensitive silver halide emulsion is placed in close contact with the fluorescent screen in order to avoid poor image sharpness.

The screen may be arranged as a separate element in contact with the radiation-sensitive outermost silver halide emulsion layer or it may form temporarily a composite structure therewith, e.g. is temporarily fixed thereto by means of a stripping layer, so that it can be removed from the silver halide emulsion layer, e.g. before the development of the silver halide emulsion layer(s).

During the radiographic exposure the intensifying screens may be provided at both sides of the present recording material. It has to be noticed that in the radiographic exposure the transparent organic photoconductive layer does not take part in the formation of a latent silver image.

For a further economy in silver the silver halide emulsion layers are colour developed in the presence of (a) colour coupler(s) so that together with the silver image a dye image is formed. When incorporated in the silver halide emulsion layers the colour couplers are preferably of the colourless type.

According to a special embodiment the radiographic silver halide recording layer is of the type described in the published German Pat. application No. 1,946,652. On colour development a monochromic dye image is produced in these silver halide emulsion layers together with a silver image which dye image mainly absorbs in the red and additionally in the green spectral region.

Radiographic colour images produced in such emulsion layers have certain advantages over black-and-white radiographs, e.g. in that they offer more visual retrieval of information and have a lower silver halide content.

The monochromic radiographic dye image preferably has its main absorption in the red region (600–700 nm) of the visible spectrum and it absorbs in the green region (500–600 nm) of the visible spectrum for at least 30 % in comparison with the absorption in the red region. In other words cyan dye images with a fairly large side-absorption in the green region and blue dye images are favoured.

For this purpose, those phenol or $\alpha$-naphthol type colour couplers are particularly suitable, which on colour development of the silver halide with an aromatic primary amino developing agent form a quinoneimine dye mainly absorbing in the red and green regions and having an absorption maximum in the spectral wavelength range of 550 to 700 nm.

Phenol couplers having such properties correspond, e.g., to the following general formula:

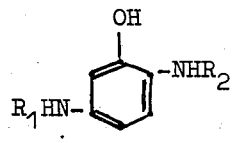

wherein:

each of $R_1$ and $R_2$ represents a carboxylic acid acyl or sulphonic acid acyl group including said groups in substituted state, e.g. an aliphatic carboxylic acid acyl group, an aromatic carboxylic acid acyl group, an heterocyclic carboxylic acid acyl group, e.g. a 2-furoyl group or a 2-thienoyl group, an aliphatic sulphonic acid acyl group, an aromatic sulphonic acid acyl group, a sulphonyl thienyl group, an aryloxy-substituted aliphatic carboxylic acid acyl group, a phenyl carbamyl aliphatic carboxylic acid acyl group, or a tolyl carboxylic acid acyl group.

For such types of phenol colour couplers and their preparation reference may be made to U.S. Pat. Nos. 2,772,162 and 3,222,176 and to United Kingdom Patent Specification No. 975,773.

The image-forming silver halide emulsions may be chemically sensitized by any of the known techniques. They may be digested with naturally active gelatin or with small amounts of sulphur-containing compounds such as allyl thiocyanate, allylthiourea, sodium thiosulphate, etc. The image-forming emulsions may also be sensitized by means of reductors e.g. tin compounds as described in the United Kingdom Patent Specification No. 789,823, polyamines e.g. diethyltriamine, and small amounts of noble metal compounds such as gold, platinum, palladium, iridium, ruthenium, and rhodium as described by R. Koslowsky, Z.wiss.Phot. 46, 67–72 (1951). Representative examples of noble metal compounds are ammonium chloropalladate, potassium chloroplatinate, potassium chloroaurate and potassium aurithiocyanate.

Emulsion stabilizers and antifoggants may be added to the silver halide emulsion before or after admixture of the low-speed emulsion, e.g., the known sulphinic and selenic acids or salts thereof, aliphatic, aromatic or heterocyclic mercapto compounds or disulphides e.g. those described and claimed application published German Patent Applicaton No. 2,100,622, preferably comprising sulpho groups or carboxyl groups, mercury compounds e.g. those described in Belgian Patent Specification Nos. 524,121, 677,337, 707,386 and 709,195 and tetra-azaindenes as described by Birr in Z.wiss.Phot. 47, 2-58, (1952), e.g. the hydroxy-tetraazaindenes of the following general formula:

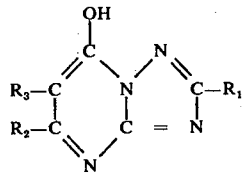

wherein:

each of $R_1$ and $R_2$ represents hydrogen, an alkyl, aralkyl, or aryl group, and $R_3$ represents hydrogen, an alkyl, carboxy, or alkoxycarbonyl group, such as 5-methyl-7-hydroxy-s-triazolo[1,5-a]pyrimidine.

Other additives for example hardening agents such as formaldehyde, dialdehydes, hydroxy aldehydes, mucochloric and mucobromic acid, acrolein and glyoxal, mordanting agents for anionic colour couplers or dyes formed therefrom plasticizers and coating aids e.g. saponin, e.g. dialkylsulphosuccinic acid salts such as sodium diisooctylsulphosuccinate, alkylaryl polyether sulphuric acids, alkylarylpolyethersulphonic acids, carboxyalkylated polyethyleneglycol ethers or esters as described in French Patent Specification No. 1,537,417 such as iso—$C_8H_{17}$—$C_6H_4$—$(OCH_2CH_2)_8OCH_2COONa$, fluorinated surfactants e.g. those described in Belgian Patent Specification No. 742,680 and the published German Pat. application Nos. 1,950,121 and 1,942,665, inert particles such as silicon dioxide, glass, starch and polymethyl methacrylate particles can be present in one or more of the hydrophilic colloid layers of the radiation-sensitive silver halide elements of the present invention.

For the purpose of accelerating the development, the exposed silver halide emulsion layer(s) is (are) developed preferably in the presence of development accelerators. These development accelerators can be used either in the silver halide emulsion or in the developing bath. They include alkylene oxide compounds of various types e.g. alkylene oxide condensation products or polymers as described in U.S. Pat. Nos. 1,970,578, 2,240,472, 2,423,549, 2,441,389, 2,531,832 and 2,533,990 and in United Kingdom Patent Specification Nos. 920,637, 940,051, 940,340, 991,608 and 1,015,023. Other development accelerating compounds are onium and polyonium compounds preferably of the ammonium, phosphonium an sulphonium type e.g. trialkyl sulphonium salts such as dimethyl-n-nonyl sulphonium p-toluene sulphonate, tetraalkylammonium salts such as dodecyltrimethylammonium p-toluene sulphonate, alkylpyridinium and alkylquinolinium salts such as 1-m-nitrobenzylquinolinium chloride and 1-dodecylpyridinium chloride, bis-alkylenepyridinium salts such as N,N'-tetramethylene-bispyridinium chloride, quaternary ammonium and phosphonium polyoxyalkylene salts especially polyoxyalkylene bispyridinium salts, examples of which can be found in U.S. Pat. No. 2,944,900, etc.

The radiographic silver halide elements used in the process of the present invention after radiographic exposure are developed, preferably in an energetic surface developer. The high energy is required in order to allow the development to proceed quickly and can be obtained by properly alkalizing the developing liquid (pH 9–12) and by using high-energy developing substances or a combination of developing substances, which as a consequence of their superadditive action is very energetic.

When colour images are prepared together with silver images, use is made of aromatic primary amino colour developing agents e.g. N,N-dialkyl-p-phenylene diamines and derivatives thereof, e.g. N,N-diethyl-p-phenylenediamine, N-butyl-N-sulphobutyl-p-phenylenediamine, 2-amino-5-diethylaminotoluene hydrochloride and 4-amino-N-ethyl-N(β-methane sulphonamidoethyl)-m-toluidine sesquisulphate monohydrate and N-hydroxy-ethyl-N-ethyl-p-phenylenediamine. The colour developer can be used together with black-and-white developing agents e.g. 1-phenyl-3-pyrazolidinone and p-monomethylaminophenol, which are known to have a superadditive effect on colour development (see L. F. A. Mason, J.Phot.Sci. 11 (1963) 136–139), and other p-aminophenol derivatives e.g. those according to French Patent Specification No. 1,283,420 such as 3-methyl-4-hydroxy-N,N-diethylaniline, 3-methyl-4-hydroxy-N-ethyl-N-β-hydroxyethylaniline, 1-methyl-6-hydroxy-1,2,3,4-tetrahydroquinoline, 1-β-hydroxyethyl-6-hydroxy-1,2,3,4-tetrahydroquinoline, N-(4-hydroxy-3'-methylphenyl)-pyrrolidine, etc. It is also possible to use combinations of aromatic primary amino colour developing agents to obtain an increased rate of colour development (see e.g. German Patent Specification No. 954,311 and French Patent Specification No. 1,299,899); favourable effects are obtained e.g. by the use of N-ethyl-N-2-hydroxyethyl-p-phenylenediamine together with N-butyl-N-sulphobutyl-p-phenylenediamine, 2-amino-5-diethylaminotoluene hydrochloride or N,N-diethyl-p-phenylenediamine hydrochloride. A superadditive colour development effect is also obtained when using a tetraalkyl-p-phenylenediamine derivative as described in published German Patent application No. (DOS) 2,156,479 together with an aromatic primary amino colour development agent.

The developing solutions may also comprise any of the usual additional ingredients e.g. sodium sulphite and hydroxylamine or derivatives thereof, hardening agents, antifoggants, e.g. benzotriazole, 5-nitro-benzimidazole, 5-nitro-indazole, halides such as potassium bromide, silver halide solvents, toning and intensifying compounds, solvents e.g. dimethylformamide, dimethylacetamide and N-methyl-pyrrolidone for chemical ingredients that are difficult to dissolve in the preparation of the developing solutions or that tend to precipitate upon standing, etc.

The radiation-sensitive emulsions for use in the present invention may be coated on a wide variety of supports e.g. films of cellulose nitrate, cellulose esters, polyvinylacetal, polystyrene, polyethylene terephthalate and other polyester materials as well as α-olefin-coated papers e.g. paper coated with polyethylene or polypropylene.

Preferred supports comprise a linear condensation polymer, polyethylene terephthalate being an example thereof.

The supports used in the present recording materials may be lightly tinted e.g. blue tinted and may be coated with subbing layers for improving the adherence thereto of (a) gelatino-silver halide emulsion layer(s).

The mechanical strength of melt extruded support of the polyester type can be improved by stretching. In some cases as described in the United Kingdom Patent application No. 1,234,755 the support may carry a subbing layer in the stretching stage.

Suited subbing layers are known to those skilled in the art of silver halide photography. With regard to the use of hydrophobic film supports reference is made to the composition of subbing layers described in the United Kingdom Patent Specification No. 1,234,755.

According to said specification a hydrophobic film support has a layer, which is directly adherent to the said hydrophobic film support and comprises a copolymer formed from 45 to 99.5 % by weight of at least one of the chlorine-containing monomers vinylidene chloride and vinyl chloride, from 0.5 to 10 % by weight of at least an ethylenically unsaturated hydrophilic monomer, and from 0 to 54.5 % by weight of at least one other copolymerisable ethylenically unsaturated monomer, and a layer comprising in a ratio of 1:3 to 1:0.5 by weight of a mixture of gelatin and a copolymer of 30 to 70 % by weight of butadiene with at least one copolymerisable ethylenically unsaturated monomer.

For common emulsion preparation processes and the use of particular emulsion ingredients reference is made in general to the Product Licensing Index of December 1971 in which the following terms are dealt with in more details:

| | |
|---|---|
| I/II | Emulsion type and preparation of said element |
| III | Chemical sensitization |
| IV | Development modifiers |
| V | Antifoggants and stabilizers |
| VI | Developing agents |
| VII | Hardeners |
| VIII | Binding agents or polymers for silver halide layers and other layers |
| IX | Antistatic layers |
| X | Supports |
| XI | Plasticizers and lubricants |
| XII | Coating aids |
| XV | Spectral sensitization agents for silver halides |
| XXIII | Colour material ingredients |
| XVI | Absorbing and filter dyes |
| XXI | Physical development systems |
| XVII + XVIII | Addition agents and coating procedures. |

The image-wise exposed radiographic elements for image intensification according to the present invention are preferably processed in an automatic processing apparatus for X-ray films in which the photographic material may be guided automatically and at a constant speed from one processing unit to the other, but it will be understood by those skilled in the art that the radiographic image recording elements disclosed herein can also be processed apart from the above mentioned automatic processing apparatus, in a variety of ways, such as by using the manual conventional multi-tank methods well known in the art.

Although especially suited for use in X-ray recording the recording materials of the present invention are intended for all types of exposure to radiation which results in the formation of a latent silver image in the silver halide emulsion layer(s).

The information-wise exposure may be of the type in which all parts of the radiation pattern simultaneously strike the silver halide emulsion layer(s) or may be an exposure, which proceeds progressively e.g. is effected line-wise or scanning-wise e.g. by means of a scanning modulated light spot.

According to an embodiment, which is interesting because of its simple processing procedure, a recording material is used containing a silver halide emulsion layer of the negative type suited for use in document reproduction and containing as developing agent e.g. hydroquinone. The emulsion layer is subjected to a reflex exposure to a document while the emulsion layer is kept in contact with a surface reflectins white light. The development of such emulsion layer is carried out by means of an alkaline aqueous solution (e.g. a 5 % aqueous sodium hydroxide), which is supplied to the silver halide emulsion recording layer with a lick-roller and non-differentially absorbed therein. Immediately after that processing, which herein is called a "mono-bath" processing, the recording material is squeezed between two rollers in order to remove a major amount of moisture, whereupon the substantially dry photoconductive layer is dried, charged non-differentially and exposed through the image-containing emulsion layer. The obtained electrostatic image is developed in the usual way and the toner image fixed. For preventing overall fogging the residual silver halide may be stabilized or fixed and the silver image optionally removed by bleaching when the toner image itself is sufficiently spectrally dense.

In the automatic processing at elevated temperatures of radiation-sensitive silver halide elements it is preferred to use a hardening developer. In these developers the hardening agent is generally an aldehyde hardener, particularly an aliphatic dialdehyde e.g. maleic aldehyde and glutaraldehyde, which may be used as such or in the form of their bisulphite addition products.

The silver halide emulsion layers that include the developer may be of the type that can be thermally developed (as described e.g. in the published German Patent application No. (DOS) 2,162,714 or of the type that operates in a wet development with an aqueous alkaline liquid (activator liquid) containing no silver halide developing compound.

When images with a high gradation have to be formed, e.g. for graphic art purposes, a so-called lith-development is preferably applied. As light-sensitive silver halide emulsions suited for the reproduction of graphic line or screen images, lith type emulsions of the silver chloride, silver chlorobromide or silver chlorobromoiodide type (containing normally less than 1 mole % of iodide) are generally employed.

For such type of emulsions and an improved development thereof reference is made to the German Patent Specification No. 1,141,531 and the published German Patent application No. (DOS) 1,597,478.

The silver halide emulsion(s) may be of the negative or direct-positive type. Suitable direct-positive type silver halide emulsions are described e.g. in the United Kingdom Patent Specification Nos. 667,206, 698,576, 796,873, 821,251 and 834,839.

According to an embodiment that is interesting when use is made of light-sensitive silver halide emulsions ungergoing a rapid overall fogging after developing, e.g., a high-speed silver halide emulsion, a "two-bath" processing is preferably applied. In such a processing the image-wise exposed recording material is first moistened with the alkaline activator solution whereupon the development is stopped by means of a stop-bath or stabilizing bath. A stop-bath essentially contains an acid for neutralizing the alkali of the activator bath. A stabilizing bath substantially contains a compound transforming light-sensitive silver halide in a non-light-sensitive or less light-sensitive silver compound. A usual stop-bath contains, e.g., acetic acid and a stabilizing agent, e.g., ammonium thiocyanate. An acid fixing bath containing thiosulphate ions may perform both functions of lowering the pH and transforming the non-developed silver halide in a less light-sensitive compound. A "four-bath" processing yielding high quality and stable silver images has been described in the U.K. Patent Specification No. 1,243,180 which Specification has to be read in conjunction herewith.

In the development step of the silver halide emulsion layers used according to the present invention it is not necessary to develop the emulsion up to the maximum density since already a useful differentiation in conductivity in the photoconductive layer can be obtained by irradiating the photoconductive layer through the emulsion layer containing a silver image or superposed silver images having a density difference of at least 0.05. This makes possible an important decrease of the development time and reduces the possibility of overall fogging of the emulsion in a processing without stop- or stabilizing bath.

In the preparation of the recording material of the present invention the coating of the photoconductive recording layer preferably precedes that of the silver halide emulsion layer(s).

According to common practice the photoconductive substance(s) involved; either alone or together with the necessary additives, are first dissolved in a suitable organic solvent such as a chlorinated hydrocarbon, e.g. methylene chloride. The solution or dispersion thus obtained is uniformly spread on a surface of a suitable transparent support, e.g. by centrifuging, spraying, brushing or coating. Thereupon the layer formed is dried in such a way that a solid photoconductive layer is formed on the surface of the support.

The silver halide emulsion layer(s) are coated at the opposite side of the support, which side is preferably provided with a subbing layer for improving the adherence of the hydrophilic colloid silver halide emulsion layer to the normally rather hydrophobic resin support.

The coating of the silver halide emulsion layer(s) may proceed by any technique known to those skilled in the art e.g. by applying one of the coating techniques described by G. F. Duffin in Photographic Emulsion Chemistry, The Focal Press, London (1966), pages 153–156. In the same book information can be found about the emulsion preparation and the ingredients used therein.

Recording materials containing organic photoconductive substances can be used in a negative corona charging as well as in a positive corona charging mode.

In order to obtain an electrostatic image it is possible to effect the charging and exposure steps simultaneously and even to expose the recording layer image-wise before charging since a conductivity image is formed that is not destroyed immediately, especially if diazonium salts are used in the recording element. It is preferred, however, that the charging is effected before image-wise exposure.

Suitable exposure sources for non-spectrally sensitized photoconductive layers are commonly used ultraviolet emitting lamps e.g. high pressure mercury vapour lamps. Spectrally sensitized photoconductive layers can be exposed with lamps emitting visible light e.g. incandescent lamps, fluorescent lamps and flash lamps.

The conversion of the electrostatic latent image into a visible image can occur according to one of the techniques known in electrophotography, wherein use is made of the electrostatic attraction or repulsion of electrostatically attractable material e.g. finely divided coloured substances, which, e.g. are present in a powder mixture, in an electrically insulating liquid (e.g. in the form of a suspension as in an electrophoretic developer) or in a gas (e.g. in the form of an aerosol), or wherein electrostatic attraction is used for selective liquid deposition by selectively wetting charged portions of the recording layer, as described e.g. in the U.K. Patent Specification Nos. 1,020,505 and 1,033,419.

When the sign of the charge of the developing powder or developing liquid is properly chosen, either a negative or a positive print can be obtained from the silver image. If both the photoconductive layer and developing powder or developing liquid have the same sign of charge, the developing material only adheres to the discharged areas so that an image with opposite gradation and possibly of contrasting colour with respect to the image in the silver halide emulsion layer(s) is obtained. This may be useful for improving the visual retrieval of the image information as explained in French Patent Specification No. 2,016,178.

If a coloured powder is used for making visible the latent image, the visible image is fixed according to one of the methods known in electrophotography, e.g. by heating or by a solvent making the developer material adherent to the photoconductive layer surface.

Thermoplastic organic photoconductive recording layers used in the invention can also be developed according to a technique applied in thermoplastic recording to form a frost or ripple-image as described, e.g., in the United Kingdom Patent Specification No. 964,881 and Phot. Sci. Eng., Vol. 7, No. 1, January—February (1963) 12–13.

Evidently the present invention by no means is limited to the use of particular photoconductive compounds with the proviso, that sufficiently transparent coatings or sheets are obtained. Thus, it is possible to apply in the photoconductive layer in conjunction with the organic photoconductive substance(s) a minor amount e.g. less than 5 % by weight of inorganic opaque-photoconductive substances e.g. white photoconductive zinc oxide particles that optionally are spectrally sensitized.

The present invention is further illustrated with the following Examples. The percentages or ratios are by weight unless otherwise stated.

EXAMPLE 1

To a polyethylene terephthalate support of 100 μm a conductive transparent coating was applied from an aqueous solution of gelatin and CALGON CONDUCTIVE POLYMER 261 (trade name) in a weight ratio of 2:1. The coating was carried out in such a way that the dried coating contained 2 g of gelatin per sq.m. The surface electrical resistance of the coating was about 5 $\times 10^6$ Ohm per square at a relative humidity degree of 50 %.

Onto said conductive coating a photoconductive layer composition was coated from a solution containing a photoconductive compound:

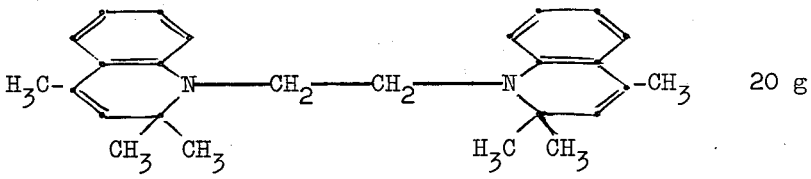

20 g (prepared as described in the published German Patent application No. (DOS) 2,160,873); as binding agents:

| | |
|---|---|
| copoly(vinyl chloride/vinyl acetate/ maleic anhydride) (mole ratio 85.5/ 13.3/0.2 | 45 g |
| silicone resin | 6.7 g |
| 1,2-dichloroethane | 45 g |

The weight of the dried photoconductive layer was 85 g per sq.m.

The other side of the polyethylene terephthalate support being presubbed for a gelatin containing layer was coated at the subbed side with a silver halide emulsion suited for radiographic recording. Therefor a silver bromoiodide X-ray emulsion (1.5 mole % of silver iodide) was prepared in such a way that it contained silver halide grains with an average grain size of 0.60 μm and comprised per kg an amount of silver halide corresponding to 190 g of silver nitrate and 74 g of gelatin. As stabilizing agents the emulsion contained per kg 545 mg of 5-methyl-7-hydroxy-s-triazolo[1,5-a]pyrimidine, 6.5 mg of 1-phenyl-5-mercaptotetrazole, and 0.45 mg of mercury cyanide. The silver halide emulsion was spectrally sensitized for green light with a spectral sensitizing agent corresponding to the structural formula:

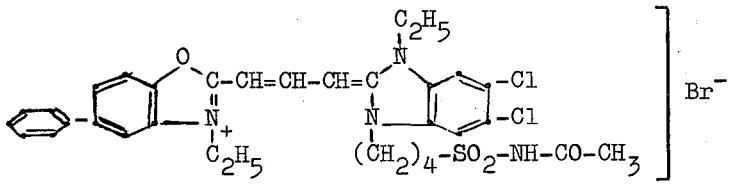

applied in an amount of 120 mg per mole of silver halide.

The above emulsion was coated onto the subbed side of the polyethylene terephthalate support in such a way that an amount of silver halide equivalent to 6 g of silver nitrate per sq.m. was present.

The emulsion layer was coated with a gelatino antistress layer at a coverage of 1 g per sq.m.

The recording material was arranged between two fluorescent intensifying screens comprising as luminescent material gadolinium oxysulphide activated with terbium and exposed to 60 kV X-ray radiation through an aluminium test wedge object in order to produce a wedge image on development.

After removal of the fluorescent screens the radiographic materials were processed in an automatic 90 seconds processing machine, the development occurred for 23 seconds at 35°C in Agfa-Gevaert's hardening developer G 138 which comprises hydroquinone and 1-phenyl-3-pyrazolidinone as developing agents and glutaraldehyde as hardener.

After drying of the recording material the photoconductive layer was subjected to a negative corona charging with a potential difference of −5200 V exposed through the wedge image print contained in the emulsion layer with 5 Osram (trade name) L 20 fluorescent tubes placed at a distance of 20 cm from the developed silver halide emulsion layer.

After the exposure the electrostatic latent image formed on the photoconductive layer was developed by means of an electrophoretic developer prepared by diluting the concentrated developer composition described hereinafter in a volume ratio of 15/1000 by means of Isopar H (an isoparaffinic hydrocarbon mixture having a boiling range of 177°–188°C of Esso Belgium N.V., Antwerp, Belgium):

| | |
|---|---|
| carbon black (average particle size : 10 nm) | 30 g |
| zinc monotridecyl phosphate as dispersing agent | 1.5 g |

-continued

| | |
|---|---|
| ISOPAR H (trade name) | 750 ml |
| resin solution prepared as described hereinafter | 150 g |

The resin binder solution was prepared by heating 500 g of ALKYDAL L 67 (of Farbenfabriken Bayer AG, Leverkusen, W. Germany, for a linseed oil-modified (67 % by weight) alkyd resin and 500 ml of white spirit containing 11 % by weight of aromatic compounds at 60°C till a clear solution was obtained, and subsequent cooling.

A black positive copy of the wedge print contained in the developed silver halide emulsion layer was obtained.

The wedge print step area of the developed silver halide emulsion layer corresponding with a spectral density for visible light of 0.5 (measured before the charging, exposure and development of the photoconductive layer) obtained after said electrophoretic development of the photoconductive layer a spectral density of about 1.00 measured in transmission.

EXAMPLE 2

A direct positive silver iodobromide emulsion, containing 95 g of silver halide (98 mole % of silver bromide and 2 mole % of silver iodide) was prepared. The ratio of hydrophilic colloid to silver halide, expressed as silver nitrate, was 0.45.

After addition of a desensitizing nitro-styryl or nitrobenzylidene dye and a methine dye, as described in United Kingdom Patent Specification No. 1,155,404, and the necessary wetting agents and hardening agents (mucochloric acid), the emulsion was coated on a polyethylene terephthalate support already provided with a conductive intermediate layer and photoconductive coating as described in Example 1 at such a rate that an amount of silver halide corresponding with 10 g of silver nitrate per sq.m was applied.

The emulsion layer was then overcoated with a gelatin antistress layer.

The silver halide emulsion layer was exposed through a continuous grey wedge with constant 0.15 by means of incandescent bulbs.

The exposed material was processed in an automatic 90 seconds processing machine. Development lasted 23 seconds at 35°C in a hardening developer for automatic processing which comprises hydroquinone and 1-phenyl-3-pyrazolidinone as developing agents and glutaraldehyde as hardener.

The photoconductive coating was charged, exposed and developed as described in Example 1. The spectral density increase obtained thereby was about 100 % in the area corresponding with density about 1 of the silver metal wedge image.

I claim:

1. A method for intensifying low density silver images comprising the steps of:

1. providing a photographic material comprising a support coated on one side with at least one silver halide emulsion layer and on the opposite side with an electroconductive interlayer having a resistivity not higher than about $10^9$ ohm.cm. and a conductivity at least 1000 times that of said support and is in turn coated with a photoconductive layer having a thickness of about 1–20 $\mu$m and consisting essentially of at least one organic photoconductive compound, each such silver halide emulsion layer yielding on exposure with actinic light a latent image which is reducible to a silver image upon treatment with a photographic developing agent, said electroconductive interlayer having a resistivity at least 1000 times smaller than that of the photoconductive layer, and said support, said conductive interlayer and said photoconductive layer having an aggregate spectral density not exceeding 0.3 in the wavelength range of 400 to 700 nm,
2. imagewise exposing such silver halide emulsion layer to penetrating radiation to form a low density latent silver image therein,
3. treating the latent silver image with a photographic developing agent to form a visible image thereof,
4. electrostatically charging the photoconductive layer,
5. exposing the electrostatically charged photoconductive layer through such developed emulsion layer containing said visible image to produce an electrostatic charge pattern according to said image,
6. developing the electrostatic charge pattern thus produced on the photoconductive layer with electrostatically attractable material, and
7. fixing of the electrostatically deposited material onto the photoconductive layer thereby to intensify said low density silver image.

2. A process according to claim 1 wherein the imagewise exposure of such silver halide emulsion layer is with fluorescing light emitted from a fluorescent screen exposed to imagewise modulated X-rays.

3. A process according to claim 1 wherein said electrostatic latent image is developed with an electrophoretic developer liquid containing said electrostatically attractable material dispersed therein.

* * * * *